United States Patent [19]

Fujii et al.

[11] Patent Number: 4,845,919

[45] Date of Patent: Jul. 11, 1989

[54] EAR FOLDING APPARATUS

[75] Inventors: Isao Fujii; Sanjyuro Osada; Masato Okamoto; Kouichi Yamamoto, all of Mihara, Japan

[73] Assignee: Mitsubishi Jukogyo Kabushiki Kaisha, Tokyo, Japan

[21] Appl. No.: 138,087

[22] Filed: Dec. 28, 1987

[30] Foreign Application Priority Data

Jan. 7, 1987 [JP] Japan ..... 62-559

[51] Int. Cl.[4] ..... B65B 11/04; B65B 11/12; B65B 11/22; B65B 11/32

[52] U.S. Cl. ..... 53/380; 53/204

[58] Field of Search ..... 53/409, 380, 378, 211, 53/217, 204, 465

[56] References Cited

U.S. PATENT DOCUMENTS

| | | | |
|---|---|---|---|
| 2,919,527 | 1/1960 | Smith et al. | 53/380 X |
| 3,633,335 | 1/1972 | Johnson | 53/380 |
| 3,807,132 | 4/1974 | Kamiya | 53/204 |
| 3,924,375 | 12/1975 | Brenner et al. | 53/380 |
| 4,184,307 | 1/1980 | Kataoka | 53/380 |

FOREIGN PATENT DOCUMENTS

| | | |
|---|---|---|
| 45-24370 | 9/1970 | Japan . |
| 45-35477 | 11/1970 | Japan . |
| 51-6358 | 2/1976 | Japan . |
| 52-70690 | 6/1977 | Japan . |
| 52-48879 | 12/1977 | Japan . |
| 52-168746 | 12/1977 | Japan . |
| 54-32790 | 10/1979 | Japan . |
| 54-40920 | 12/1979 | Japan . |
| 54-43956 | 12/1979 | Japan . |
| 55-10443 | 3/1980 | Japan . |
| 55-22332 | 6/1980 | Japan . |
| 55-46930 | 11/1980 | Japan . |
| 57-104518 | 6/1982 | Japan . |
| 57-196602 | 12/1982 | Japan . |
| 58-14301 | 1/1983 | Japan . |
| 58-134824 | 8/1983 | Japan . |
| 58-134825 | 8/1983 | Japan . |

*Primary Examiner*—Horace M. Culver

*Attorney, Agent, or Firm*—Wenderoth, Lind & Ponack

[57] ABSTRACT

An ear folding apparatus for automatically folding and pleating ears of packaging material wrapped around a cylindrical article, such as a coil of strip material, is provided with a pleats-holding/inside-bending guide. The guide has a radially notched section and is movable in the axial direction of the cylindrical article. The apparatus further has a folding unit, which includes a feed roll, a folding roll and a folding claw.

14 Claims, 4 Drawing Sheets

EAR FOLDING APPARATUS

BACKGROUND OF THE INVENTION

1. Field of the Invention

The present invention relates to an ear folding apparatus that is available as an apparatus for folding ears of packaging material for cylindrical products (various types of sheet steel coils, aluminum coils and coiled sheet-like products of paper, rubber, vinyl, etc.).

2. Description of the Prior Art

In general, a metal strip coil 1 consisting of a steel strip is shipped after it has been regularly packaged by packaging material 2 for the purpose of rustproofing and scratch-proofing, as shown in FIG. 11. In the prior art, this packaging work has been achieved by hand. The coil has its outer circumference already wrapped by a packaging paper sheet in the preceding step of the process, ears 2*a* of the packing paper sheet are the folded and pleated, the central portion of the pleats are bent and stuffed into the coil bore, and finally the stuffed portion is fixed by sticking a tape or the like onto that portion. This packaging work necessitates a lot of labor and time, and hence automation of that work has been strongly required. Therefore, a number of automatic packaging apparatuses were proposed in the past.

(1) For instance, in Laid-Open Japanese Patent Specification No. 61-21313 (1986) is proposed an automatic packaging apparatus in which an ear of a packaging paper sheet for a coil is gripped at a plurality of points along its circumference and is bent towards the center of the end surface of the coil. At the same time the main body of the apparatus is moved towards the end surface of the coil, and the bent ear is pressed against the end surface of the coil to be folded thereon.

(2) Alternatively, Laid-Open Japanese Patent Specification No. 58-134824 (1983) proposes an automatic packaging apparatus in which, while a packaging paper sheet preliminarily shaped to have a cross-section configuration adapted for the shape of the coil, that is, a U-shaped cross-section configuration is being wrapped around an uter circumference of a coil, ears of the packaging paper sheet are folded.

In the case of the known apparatus described in numbered paragraph (1) above, folding devices equal in number to the number of pleats are required along the outer circumference of the coil and, moreover, since the structure and operation of the respective folding devices are complex, a high level of control technique is required. Accordingly, manufacturing cost becomes relatively high and maintenance of the apparatus is complex.

In the case of the known apparatus described in numbered paragraph (2) above, the entire apparatus is large. Because shaping of the packaging paper sheet into a U-shape in cross-section, wrapping of the packaging paper sheet around the outer circumference, and folding of the ears of the packaging paper sheet are performed at the same position, and the interval between preceding and succeeding equipment is then necessarily large the entire manufacturing line requires a large space. Also, application of the packaging apparatus to an existing manufacturing line is difficult. Furthermore, device for holding the pleats after folding and a device for bending and stuffing the folded ears into a coil bore are required separately.

OBJECTS OF THE INVENTION

It is therefore one object of the present invention to provide an ear folding apparatus for folding and pleating ears of a packaging material wrapped around the outer circumference of a coiled article to be packaged, which is free from the above-mentioned disadvantages of the ear folding apparatus in the automatic packaging appratus of the prior art.

A more specific object of the present invention is to provide an ear folding apparatus of the abovedescribed type which is relatively simple in structure and operation, of low cost, and which does not require complex maintenance.

Another specific object of the present invention is to provide an ear folding apparatus of the abovedescribed type which is not large-sized as a whole, so that the entire manufacturing line, including the ear folding apparatus, does not require a large space, and which can be readily applied to an existing manufacturing line.

SUMMARY OF THE INVENTION

According to one feature of the present invention, there is provided a novel ear folding apparatus for folding and pleating the ears of a packaging material wrapped around an outer circumference of a coiled article to be packaged, which comprises a folding unit including a feed roll, a folding roll, and a folding claw for forming a sag of packaging material on the side surface of the coiled article, and for folding and pleating of the ears of the packaging material, and a pleats-holdinginside-bending guide having a radially notched section for holding the pleats formed after folding and for bending and stuffing the folded ears into an inner bore of the coiled article.

The ear folding apparatus according to the present invention as described above operates in the following manner. When when a coil having packaging material wrapped around its outer circumference has been placed at a predetermined position, the pleats-holding-/inside-bending guide is pressed against the side surface of the coil, and the folding unit, having a pressing device such as a feed roll, a folding roll, and a folding claw assembled therein, swings while to press the ear of the packaging material, and comes into pressure contact with the side surface of the coil via the pleats-holding-/inside-bending guide.

Subsequently, the folding unit and the coil rotate relative to each other about the axis of the coil, and likewise the above-mentioned rolls also rotate about their own axes. The folding claw is engaged with the packaging material to perform the ear folding operation, the folded ear portions are successively led to the inside of the pleatsholding/inside-bending guide through a radially notched section while the relative rotation is effected, and the ear end portion is bent and stuffed into an inner bore of the coil by the pleats-holding/inside-bending guide.

Since the ear folding apparatus according to the present invention is constructed and operated as described above, it is compact in its mechanical construction, and hence can be applied not only to anewly installed manufacturing line but also to an existing manufacturing line for the purpose of folding ears of packaging material that has been preliminarily wrapped around a cylindrical product.

Moreover, it is possible to fold ears along the entire circumference by means of one set of the folding unit, and hence the structure of the apparatus is simple, reducing the manufacturing cost of the apparatus. At the same time, since the folding of ears can be performed continuously by relative rotation between the coil and the ear folding apparatus, the operation is speedy and smooth, so that automation of the packaging of a coil can be realized.

The above-mentioned and other objects, features and advantages of the present invention will become more apparent by reference to the following description of the preferred embodiments of the invention taken in conjunction with the accompanying drawings.

DETAILED DESCRIPTION OF THE PREFERRED EMBODIMENTS

First Preferred Embodiment

Figure 1:
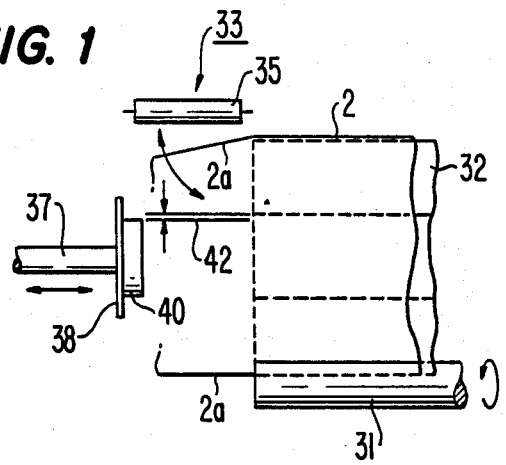
FIG. 1 is a side view showing a general construction of a first preferred embodiment of the ear folding apparatus according to the present invention.
Figure 2:
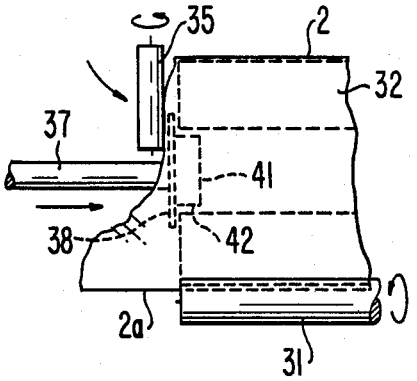
FIG. 2 is a schematic view showing an operating state of the apparatus in FIG. 1.

Referring now to FIGS. 1 to 8, a construction and an operation of an ear folding apparatus according to a first preferred embodiment of the present invention are illustrated. In the figures, reference numeral 2 designates packaging material, numeral 2*a* designates an ear, numeral 31 designate a cradle roll, numeral 32 designates a coiled article to be packaged, numeral 33 designates a folding unit, numeral 34 designates a feed roll, numeral 35 designates a folding roll, numeral 36 designates a folding claw, numeral 37 designates a movable shaft, numeral 38 designates a pleats-holding/inside-bending guide, numeral 39 designates a notched section in the guide 38, numeral 40 designates a guide cylinder, numeral 41 designates an inner bore of the coil (or simply coil bore), numeral 42 designates a gap space between the outer circumferential surface of the guide cylinder 40 and the inner circumferential surface of the coil bore 41, numeral 43 designates a projected portion of the guide 38, numeral 44 designates a slant portion of the guide 38, numeral 45 designates side surface pressing rolls, numeral 46 designates inner surface pressing rolls, numeral 47 designates a speed reduction motor, numeral 48 designates a mounting shaft for the folding claw 36, numeral 49 indicates a bent and stuffed state of the packaging material into the coil bore, and numeral 63 indicates a folded and pleated state of the ear 2*a*.

A coiled article to be packaged 32 (hereinafter simply called "coil") is placed on a plurality of cradle rolls 31, and can be rotated by a driving device for the rolls 31. Above both side surfaces of the coil 32 are disposed folding units 33, each including a feed roll 34, a folding roll 35, and a folding claw 36 in such a manner that they can be brought into pressure contact with the respective side surfaces of the coil by swinging about pivotal shafts. The folding units are adjustable upwardly, downwardly, and sideways with respect to the coil 32, so as to be able to perform an ear folding operation even if the diameter and the width of the coil are varied.

A movable shaft 37 is disposed opposite the side surface of the coil 32, and at the tip end of the shaft 37 is mounted a pleatsholding/inside-bending guide 38 having a notched section 39 and a guide cylinder 40. The movable shaft 37 is disposed as to be adjustable upwardly, downwardly and sideways with respect to the coil 32, so that the pleats-holding/inside-bending guide 38 can be positioned at the center of the coil even if the diameter and the width of the coil are varied. When the movable shaft 37 is moved towards the coil 32, the pleats-holding/inside-bending guide 38 may be pressed against the side surface of the coil with a predetermined gap space 42 retained between an outer wall surface of a guide cylinder 40 and an inner wall surface of a coil bore 41.

Figure 7:
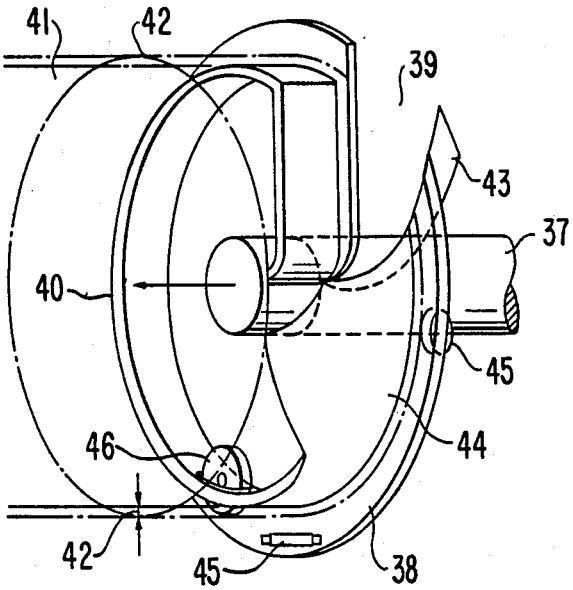
FIG. 7 is a perspective view of a pleats-holdinginside-bending guide.

Now explaining the pleats-holding/insidebending guide 38 in more detail, as shown in FIG. 7, the guide 38 includes a notched section 39 for guiding a folded and pleated portion 63, formed by folding the ear 2*a* from the front side to the rear side of the pleatsholding/inside-bending guide 38. Along one edge of this notched section 39 is provided a projected portion 43 for facilitating the guiding of the portion 63. The guide cylinder 40 has a configuration continuous with rounded slant portion 44, and extends along the inner wall surface of the coil bore 41 with the above-mentioned gap space 42 retained therebetween.

It is to be noted that the pleats-holding/insidebending guide 38 could be provided with side surface pressing rolls 45 and the guide cylinder 40 could be provided with inner surface pressing rolls 46 to smoothen the rotation of the guide 38, but the guide 38 should not be limited to the illustrated configuration. Note especially that the guide cylinder 40 can be formed as a separate member from the pleats-holding/inside-bending guide 38.

Figure 3:
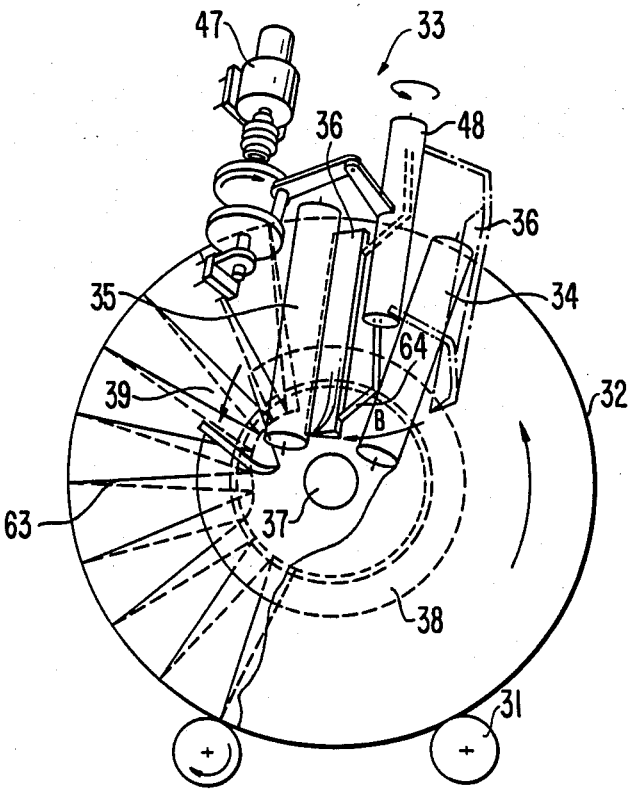
FIG. 3 is an enlarged partial perspective view illustrating an ear folding operation in the apparatus shown in FIG. 1.

The folding claw 36 is adapted to swing as shown by arrows B when a mounting shaft 48 therefor is rotated by a crank mechanism coupled to a speed reduction motor 47, as shown in FIG. 3.

In the above-described apparatus, when the coil 32 having the packaging material 2 wrapped therearound is loaded on the cradle rolls 31, the pleats-holding/inside-bending guide 38, which has its operating position preadjusted depending upon the diameter and width of the coil, is pressed against the side surface of the coil 32 by the movable shaft 37 with the gap space 42 retained between the guide cylinder 40 and the inner wall surface of the coil bore 41.

Next, the folding unit 33 (including the feed roll 34, the folding roll 35, and the folding claw 36) which has its operating position likewise preadjusted depending upon the diameter and the width of the coil, swings to press an ear 2*a* of packaging material 2 and to bring the ear 2*a* into pressure contact with the pleats-holding/inside-bending guide 38 that is preset on the side surface of the coil.

Subsequently, the coil 32 is rotated as a result of rotation of the cradle rolls 31. At the same time, the feed roll 34 and the folding roll 35, coupled to a driving device, are also rotated. By supporting and feeding the ear 2*a* of the packaging material 2, which was brought into pressure contact with the pleats-holding/inside-bending guide 38 by means of the feed roll 34 and the guide 38, a sag 64 is created between the feed roll 34 and the folding roll 35, because a difference in a circumferential length, due to a difference of a radius, is produced between the packaging material portions located at the outer circumference of the coil and on the side of the inner bore of the coil. By making this sag 64, to be bitten by the folding roll 35, at a predetermined pitch by means of the folding claw 36, the ear 2*a* is successively folded and pleated on the side surface of the coil, as indicated by reference numeral 63.

Figure 4:
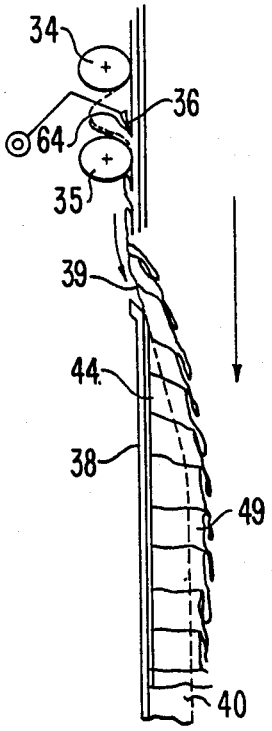
FIG. 4 is a developed view showing a bending operation for a folded ear end into an inner bore of a coil.
Figure 5:
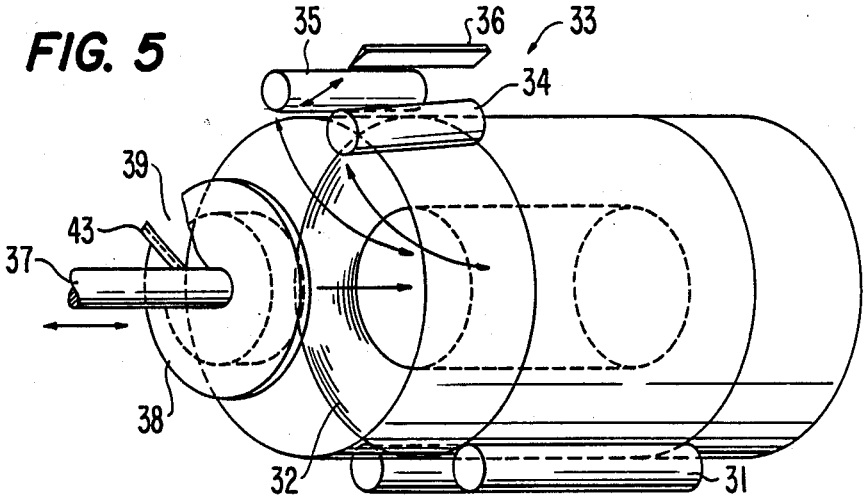
FIGS. 5 and 6 are schematic perspective views showing an ear folding operation of the apparatus in FIG. 1.
Figure 6:
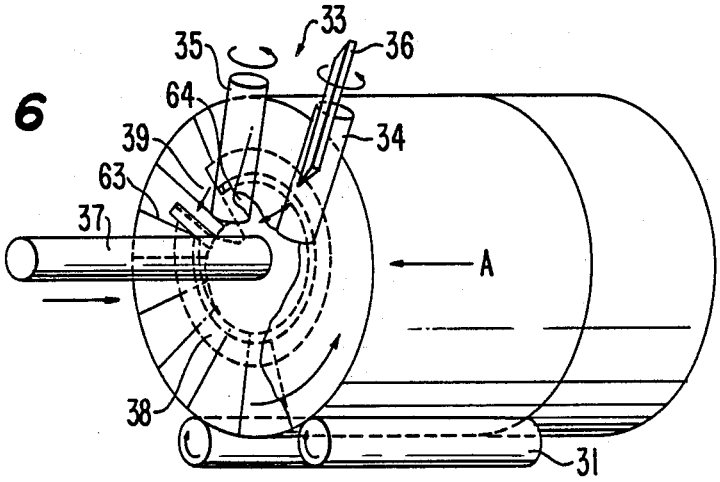
Figure 8:
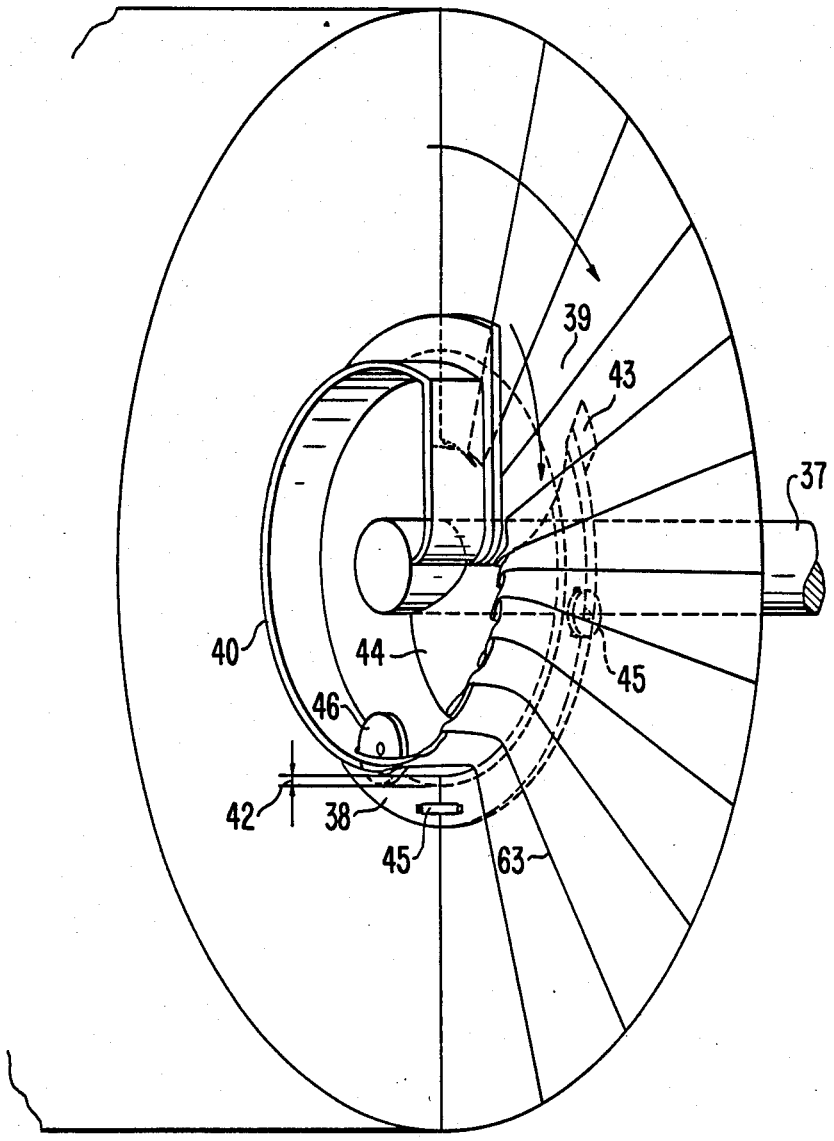
FIG. 8 is a perspective view illustrating an ear folding, bending and stuffing operation as viewed in the direction of arrow A in FIG. 6.

Meanwhile, due to the rotation of the cradle rolls 31, the folded and pleated portions are successively guided throught the notched section 39 of the pleats-holding-/inside-bending guide 38 onto the slant portion 44 of the guide cylinder 40 on the inside of the guide 38, as shown in FIGS. 4 and 8.

The slant portion 44 has a configuration like the skirts of a mountain, hence the inner portion of the folded and pleated ear 2*a* is guided into the gap space 42 on the outside of the guide cylinder 40 as a result of rotation of the coil 32, and it turns round along the inner wall surface of the coil bore 41. Thus, simultaneously with the folding and pleating of the ear 2*a*, bending and stuffing of the ear 2*a* into the coil bore 41 are carried out continuously as shown at 49 in FIG. 4.

When the folding and pleating 63 of the ear have been completed over the entire circumference, the ear 2*a* has entirely entered the inside of the pleats-holding/inside-bending guide 38 through the notched section 39 of the guide 38. Then, the cradle rolls 31 are stopped, the folding unit 33 (including the feed roll 34, the folding roll 35 and the folding claw 36) is swung up, and the pleats-holding/inside-bending guide 38 is moved to the left, returning the apparatus to its initial state.

Second Preferred Embodiment

Figure 9:
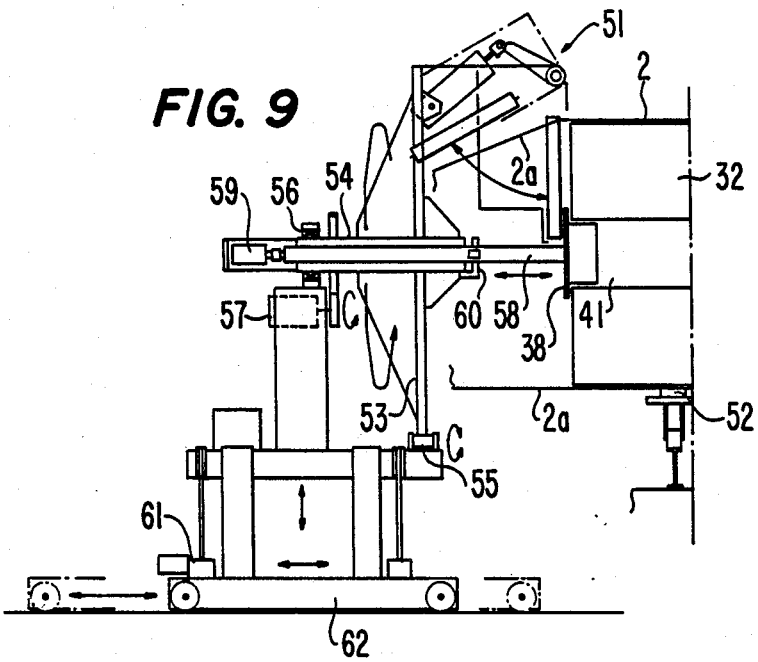
FIG. 9 is a side view of a second preferred embodiment of the present invention.
Figure 10:
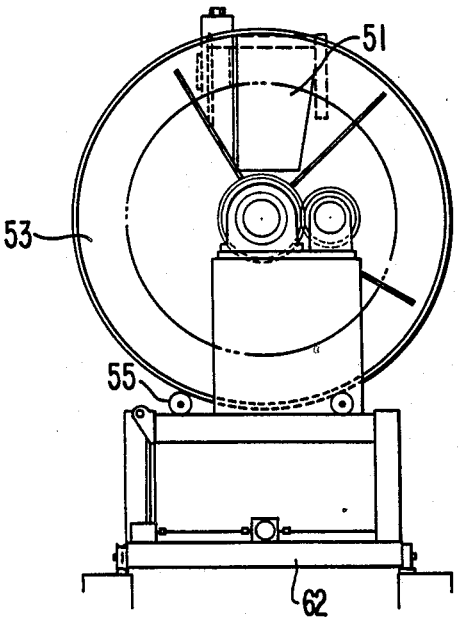
FIG. 10 is a front view of the apparatus shown in FIG. 9.
Figure 11:
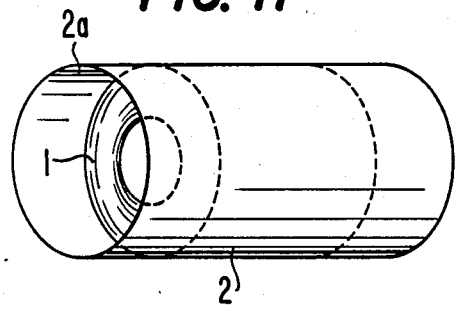
FIG. 11 is a schematic view showing the state where packaging material has been wrapped around a coil.

A second preferred embodiment of the present invention is illustrated in FIGS. 9 and 10 as a side view and a front view, respectively.

This second preferred embodiment differs from the above-described first preferred embodiment only in that the coil 32 is fixedly mounted and the folding and pleating 63 of an ear are carried out while a folding unit 51 is revolving about the center axis of the coil along the side surface of the coil. The coil 32 is placed on a V-shaped fixed coil cradle 52, and the folding unit 51, comprising a feed roll, a folding roll, and a stuffing member such as a folding claw similar to the above-described first preferred embodiment, is swingably mounted on a disc-shaped frame 53.

This frame 53 has a circumferential portion held by means of a plurality of small-sized roll-like bearings 55 and a central portion supported by a bearing 56. At the center of the frame 53 is provided a hollow shaft 54, and a gear is fixedly fitted around the hollow shaft 54 and is adapted to be rotated by an electric motor 57. In addition, a movable shaft 58 having a pleats-holding/inside-bending guide 38 mounted at its remote end is slidably inserted into the hollow shaft 54. This movable shaft 58 can be extended or retracted by means of a cylinder 59 to be adapted to the position of the side surface of the coil 32, and thereby the position of the pleats-holding-/inside-bending guide 38 can be adjusted. Also, in order that the disc-shaped frame 53 and the movable shaft 58 supporting the pleats-holding/inside-bending guide 38 can rotate integrally, a whirlstop 60 is provided. To enable the ear folding apparatus to adapt to variations in the diameter and width of a coil, the roll-like bearings 55 holding the frame 53, the bearing 56 and the motor 57 are fixedly mounted on vertically movable adjusting devices 61 which are in turn placed on a truck 62 so as to be movable in the horizontal direction.

In operation, the above-described ear folding apparatus has its height adjusted by the adjusting devices 61 so as to match with the coil 32 loaded on the coil cradle 52. The pleats-holding/inside-bending guide 38 and the folding unit 51 advance towards the side surface of the coil 32, carried by the truck 62, and the pleats-holding-/inside-bending guide 38 comes into contact with the side surface of the coil 32. The guide 38 is further pressed against the side surface of the coil 32 by the action of the cylinder 59.

Next, the folding unit 51 swings down, and while the ear 2*a* of the packaging material 2 is being pressed by the feed roll and the folding roll, the ear 2*a* is brought into pressure contact with the side surface of the coil by the intermediary of the pleats-holding/inside-bending guide 38.

The disc-shaped frame 53 then rotates about its axis, aligned with the center axis of the coil bore, at the same time the feed roll, folding roll, and folding claw operate. Similar to the above-described first preferred embodiment, while the folding and pleating 63 of the ear 2*a* are being carried out, the folded and pleated ear 2*a* is guided through the notched section 39 of the pleats-holding/inside-bending guide 38 to the inside of the guide 38, here as a result of rotation of the frame 53, and the pleated portions of the ear 2*a* are successively bent and stuffed into the coil bore 41.

When the folding and pleating of the ear 2*a* have been completed over the entire circumference of the ear, the pleats-holding/inside-bending guide 38 is moved outside of the ear 2*a*, the folding unit 51 is made to swing outwards, and the pleats-holding/inside-bending guide 38 and the folding unit 51 are retreated to a standby position, carried by the truck 62.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. An ear folding apparatus for folding and pleating ears of packaging material wrapped around the outer circumference of a coiled article to be packaged, comprising:

a folding means for folding said ears of said packaging material into pleats, said folding means including a feed roll, a folding roll, and a folding claw; and guide means for guiding and bending pleats folded by said folding means inside a coil bore of said coiled article, said guide means comprising a guide member, said guide member having a radial notch for receiving pleats to be guided and bent inside said coil bore.

2. The ear folding apparatus as set forth in claim 1, and further including means for rotating said coiled article about its longitudinal axis.

3. The ear folding apparatus as set forth in claim 1, and further including means for rotating said folding means and said guide means about the longitudinal axis of said coiled article.

4. The ear folding apparatus as set forth in claim 1, and further including means for adjusting the vertical and lateral position of said guide means to enable said guide means to be adjusted relative to said coiled article to be packaged.

5. The ear folding apparatus as set forth in claim 1, and further including means for moving said guide means in the direction of the longitudinal axis of said coiled article.

6. The ear folding apparatus as set forth in claim 1, wherein said guide means comprises a guide cylinder for entering said coil bore of said coiled article and guiding pleats against the inner surface of said coil bore.

7. The ear folding apparatus as set forth in claim 6, wherein said guide cylinder has a slant portion disposed adjacent said radial notch of said guide member for guiding pleats received by said radial notch inside said coil bore.

8. The ear folding apparatus as set forth in claim 6, wherein said guide member is circular, said circular guide member disposed adjacent said guide cylinder.

9. The ear folding apparatus as set forth in claim 1, wherein said guide member is circular.

10. The ear folding apparatus as set forth in claim 9, wherein said circular guide member has a projected portion at said radial notch.

11. An ear folding apparatus for folding and pleating ears of packaging material wrapped around the outer circumference of a coiled article to be packaged, comprising:

a folding means for folding said ears of said packaging material into pleats, said folding means including a feed roll, a folding roll, and a folding claw; and a guide plate for holding and guiding pleats folded by said folding means, said guide plate having guide means for guiding pleats from a pleat folding position on one side of said guide plate to a bent position inside a coil bore of said coiled article on the other side of said guide plate.

12. The ear folding apparatus as set forth in claim 11, wherein said guide means comprises a guide cylinder disposed on said other side of said guide plate and a radial notch in said guide plate, said guide cylinder having a slant portion adjacent said radial notch.

13. The ear folding apparatus as set forth in claim 12, wherein said guide plate has a projected portion disposed on one side of said radial notch.

14. An ear folding apparatus for folding and pleating ears of packaging material wrapped around the outer circumference of a coiled article to be packaged, comprising:

a folding means including a feed roll, a folding roll, and a folding claw for forming sags of said ears of said packaging material on a side surface of said coiled article and folding said sags to form pleats, thereby pleating said ears of said packaging material; and holding and guiding means for holding pleats formed by said folding means and bending and guiding said pleats of said ear inside a coil bore of said coiled article, said holding and guiding means comprising a holding and guiding member having a radial notch for receiving pleats to be bent and guided inside said coil bore.

* * * * *